US007640690B2

(12) United States Patent
Hines

(10) Patent No.: US 7,640,690 B2
(45) Date of Patent: Jan. 5, 2010

(54) STOCK INTERFACE

(76) Inventor: Steve Hines, P.O. Box 423, Tijeras, NM (US) 87059

( * ) Notice: Subject to any disclaimer, the term of this patent is extended or adjusted under 35 U.S.C. 154(b) by 313 days.

(21) Appl. No.: 11/639,814

(22) Filed: Dec. 15, 2006

(65) Prior Publication Data

US 2009/0300963 A1 Dec. 10, 2009

Related U.S. Application Data

(60) Provisional application No. 60/833,712, filed on Jul. 27, 2006.

(51) Int. Cl.
*F41A 11/02* (2006.01)

(52) U.S. Cl. ..... 42/75.03; 42/84

(58) Field of Classification Search ..... 42/75.01, 42/75.03, 72, 84
See application file for complete search history.

(56) References Cited

U.S. PATENT DOCUMENTS

| | | | | |
|---|---|---|---|---|
| 3,250,034 | A * | 5/1966 | Simmons | 42/84 |
| 3,267,601 | A | 8/1966 | Roy | 42/73 |
| 3,348,328 | A | 10/1967 | Roy | 42/73 |
| 4,141,166 | A * | 2/1979 | Schultz | 42/70.03 |
| 5,941,005 | A | 8/1999 | Battaglia et al. | 42/70.08 |
| 6,543,172 | B1 | 4/2003 | Armstrong | 42/71.01 |
| 6,651,371 | B2 | 11/2003 | Fitzpatrick et al. | 42/72 |
| 6,874,267 | B2 | 4/2005 | Fitzpatrick et al. | 42/72 |
| 6,925,744 | B2 | 8/2005 | Kincel | 42/71.01 |
| 6,951,071 | B1 * | 10/2005 | Acosta et al. | 42/69.01 |
| 2004/0003529 | A1 | 1/2004 | Danielson | 42/114 |
| 2004/0055200 | A1 | 3/2004 | Fitzpatrick et al. | 42/72 |
| 2004/0255505 | A1 * | 12/2004 | Fitzpatrick | 42/72 |
| 2005/0183315 | A1 | 8/2005 | Davis | 42/71.01 |

* cited by examiner

*Primary Examiner*—Bret Hayes
(74) *Attorney, Agent, or Firm*—Richard H. Krukar; Kermit D. Lopez; Luis M. Ortiz

(57) ABSTRACT

A stock interface can be slipped onto and attached to a standard CAR buffer tube. The stock interface provides structures for attaching a butt stock and stock interface attachments such as an ergonomic attachment, a container attachment, and a power attachment. Small arms ergonomics can be improved by providing a better cheek weld via an ergonomic attachment. Container attachments provide storage. Power attachments provide electrical power for items such as electronic sighting systems, lasers, lights, or any of the other electronic devices attached to a small arm.

3 Claims, 9 Drawing Sheets

STOCK INTERFACE

RELATED APPLICATIONS

This patent application claims the priority and benefit of U.S. Provisional Patent Application No. 60/833,712 filed on Jul. 27, 2006 entitled "Stock Interface" and which is incorporated herein by reference in its entirety.

TECHNICAL FIELD

Embodiments relate to fields of small arms, rifle stocks, and modular rifle stocks. Embodiments also relate to the fields of power sources and electrical interconnections.

BACKGROUND

Small arms design has moved past using fixed stock elements to using adjustable or modular components. Adjustable or modular components are used to configure a firearm for specific uses or missions. For example, U.S. Pat. No. 3,348,328 issued to Roy discloses an adjustable stock for use in conjunction with a CAR buffer tube. A buffer tube is a tube mounted to the back of a firearm receiver. In most applications, when the firearm is discharged, the bolt travels back and into the buffer tube while a spring, called the buffer spring, supplies a force for decelerating the bolt and returning it to a forward position. FIG. 1B of U.S. Pat. No. 5,941,005 illustrates a spring in a buffer tube.

Roy, however, uses a specially formed CAR buffer tube for use with his adjustable stock. Many buffer tubes are simply cylinders that are appropriately sized for holding a buffer spring and decelerating the bolt. The CAR buffer tube is a buffer tube with an elongated rib and a groove. The CAR buffer tube is a standard part of certain military issue small arms. U.S. Pat. No. 3,348,328 contains illustrations of a CAR buffer tube, a stock element that slides onto the CAR buffer tube, and a locking mechanism that can lock the sliding stock in a variety of positions.

Standard CAR buffer tubes, such as those used with the M4 and M16 carbines, have been attached to shotgun receivers. Some shotguns equipped with CAR buffer tubes do not use a buffer spring within the CAR buffer tube to achieve semiautomatic operation.

FIG. 11, labeled as "prior art", illustrates a side view of an idealized CAR buffer tube. A cylindrical tube 1101 has a threaded end 1102 for attachment to a receiver and an elongated rib 1103 extending radially.

FIG. 12, labeled as "prior art", illustrates a bottom view of an idealized CAR buffer tube. The groove 1201 in the elongated rib 1103 can be seen. Holes 1202 are positioned in the undercut groove 1201. An adjustable stock can be locked into position by a pin pressing into a hole 1202.

FIG. 13, labeled as "prior art", illustrates a cut view of an idealized CAR buffer tube. The cylindrical tube 1101 has a sidewall 1302 and an opening 1301 that can contain a buffer spring. The groove 1201 in the elongated rib 1103 can be seen.

Other inventors have refined Roy's adjustable length butt stock. For example, U.S. Pat. No. 6,874,267, U.S. Pat. No. 6,651,371, disclose modular gunstock systems. Like Roy, these two inventions use a specially designed replacement buffer tube. An armorer trained to work on small arms replaces the original buffer tube with the replacement buffer tube. Users who are less specialized than the armorer can then configure the remainder of the modular gunstock system. Another example is U.S. Pat. No. 6,925,744 that refines Roy's adjustable length butt stock by adding compartment modules to the moveable butt stock element.

FIG. 14, labeled as "prior art", illustrates a stylized toy replica 1401 firing a pellet 1402. Many toy replicas, such as Airsoft toys, are pellet firing small arms replicas. Hobbyists enjoy engaging in mock non-lethal battles using toy replicas because they are realistic looking and fire non lethal, although often painful, pellets. Realistic toys are also used in small arms training because the toys can have the same weight, size, and accessories as firearms used in combat or police work. The toy replicas are often realistic enough that many after market accessories can be used with both small arms and with toy replicas. A toy replica of an AR16 or M4 carbine, however, uses an imitation CAR buffer tube 1403 and not a real CAR buffer tube. As such, a small arms accessory requiring replacement of the buffer tube is not suitable for use with a toy replica. The illustration of FIG. 14 is stylized because, from a distance, a toy replica can be indistinguishable from an actual small arm. Those practiced in combat training and police training are familiar with toy replicas.

FIG. 17, labeled as "prior art", illustrates a firearm 1701. More specifically, the firearm is an M16 rifle or its' civilian counterpart the AR15. The M16 1701 buffer tube is a cylindrical buffer tube inside the stock 1702. The buffer tube is threaded to the lower receiver 1703 on one end and has a threaded hole in the other end. A bolt threaded into the threaded hole bolts the stock 1702 to the buffer tube.

FIG. 18, labeled as "prior art", illustrates a firearm 1801 with an exposed buffer tube 1802. The firearm is an M16 rifle as in FIG. 17. The butt stock is removed so that the buffer tube 1802 can be seen. A bolt 1803 such as that for bolting on the stock, is threaded into the threaded hole at the end of the buffer tube 1802.

Prior art systems, however, require trained armorers or lack a comfortable cheek weld for a marksman. As such, systems and methods are needed to address shortcomings in the prior art.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

Systems and methods providing an easily installable and configurable modular gunstock are needed.

It is therefore an aspect of the embodiments to provide a stock interface and at least one fastener. The stock interface is specifically designed to slide over a CAR buffer tube. A fastener can exploit the undercut groove to fasten the stock attachment to the CAR buffer tube. For example, a properly sized nut can be positioned in the CAR buffer tube's groove so that a bolt can be inserted through the stock interface and threaded into the nut. Tightening the bolt fastens the stock interface to the CAR buffer tube in a fixed position. The stock interface can be provisioned for mounting stock interface attachments such as ergonomic attachments, container attachments, and power attachments.

Stock interface attachments can be attached to a stock interface using dovetails, interlocking fingers, or threaded hard points. Captured dovetails and interlocking fingers allow the parts to be slid together or otherwise snapped into place. As such, most infantrymen have the requisite skill to configure or customize a firearm. A threaded hard point can also be used where a threaded part is inserted into the threaded hard point to fasten the stock interface attachment to the stock interface.

An ergonomic attachment is designed to improve a marksman's or an infantryman's ability to use a firearm. Standard issue AR16 or M4 carbines have an adjustable stock on a CAR buffer tube. Accurate long distance shooting requires a comfortable and consistent cheek weld between the shooters face and the firearm. The CAR buffer tube, however, is positioned for producing a cheek weld but does not provide a comfortable or consistent cheek weld. A good cheek weld can be obtained by attaching a stock interface to the CAR buffer tube. A better one can be obtained by attaching an ergonomic attachment to the stock interface.

A container attachment is a stock interface attachment containing a compartment that can hold items such as batteries, coins, rocks, or whatever else an infantryman can fit into the compartment. A container attachment can have multiple containers. Small container attachment can be attached side by side to the stock interface to provide multiple compartments.

A power attachment is a stock interface attachment that provides electrical power through an electrical interconnect. The power source can be replaceable or a permanent part of the power attachment. For example, a power attachment can have a battery compartment for disposable batteries. Alternatively, a power attachment can permanently contain a fuel cell and, perhaps, a refillable fuel tank.

An electrical interconnect provides a way to get electrical energy into or out of a stock interface attachment. Electrodes that produce an electrical contact when attached to the stock interface can be used. A plug and socket type electrical interconnect can be used such that power is supplied when the plug is connected to the socket. An inductive interconnect can be used where inductive coupling is used to transmit power while keeping the electrical components sealed away from harm.

A stock can be attached to a mounting rail on the underside of the stock interface. For example, a Picatinny (M-1913) type mounting rail can be used. Picatinny rails and mounting hardware are well known to those practiced in small arms. As such, a stock with a Picatinny mounting configuration can be reliably and repeatedly attached to a Picatinny type mounting rail. Other types of rail can be equivalently used although the Picatinny is prevalent in many applications and markets.

The mounting rail on the underside of the stock interface can have a regularly spaced holes such that a stock can be slid onto the mounting rail and locked into position by a pin that passes through a hole in the stock.

DETAILED DESCRIPTION

Figure 1:
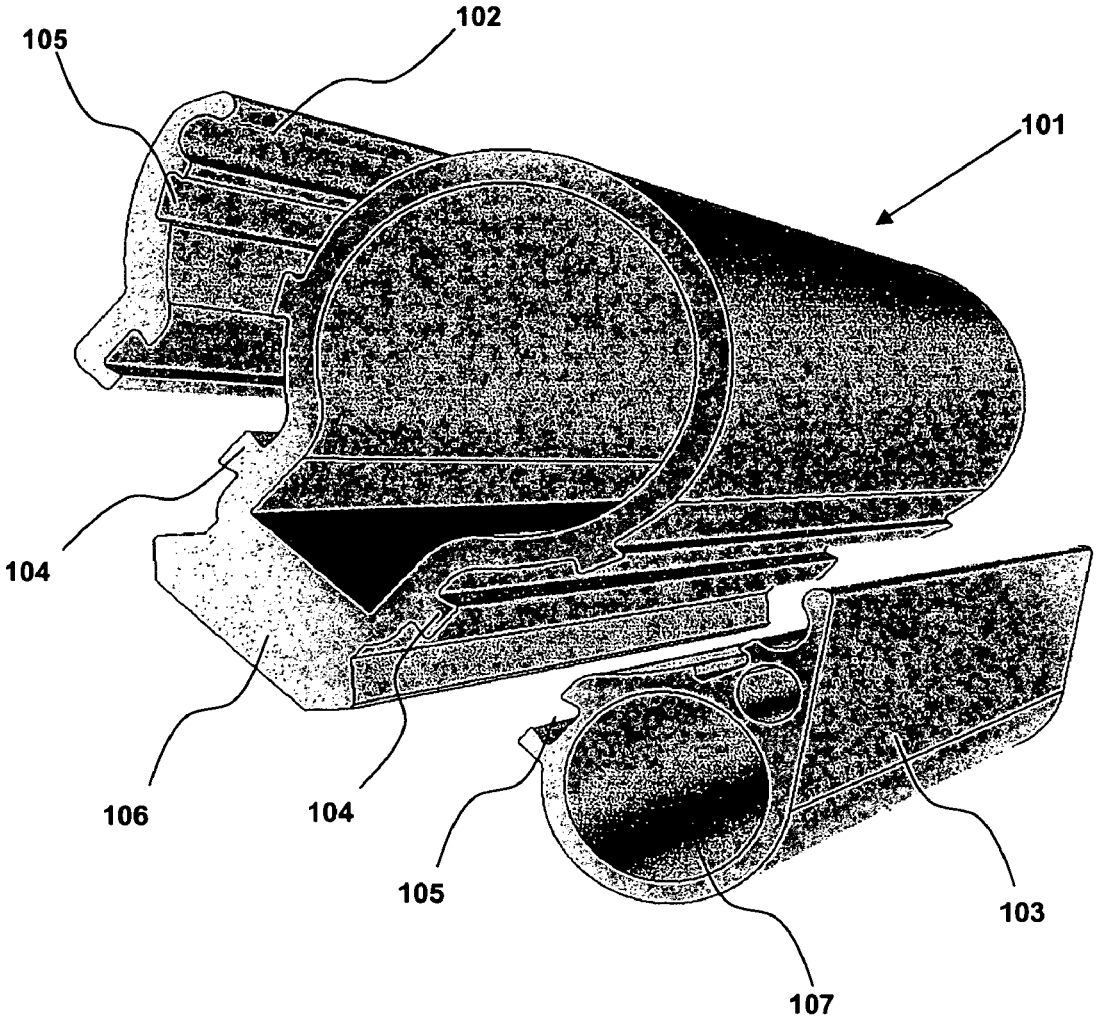
FIG. 1 illustrates a stock interface and stock interface attachments in accordance with aspects of the embodiments.

FIG. 1 illustrates a stock interface 101 and stock interface attachments 102, 103 in accordance with aspects of the embodiments. The stock interface 101 is designed to slip over a CAR buffer tube. An ergonomic attachment 102 and a container attachment 103 are designed to attach to the stock interface. Notice that symmetry allows the stock interface attachments 102, 103 to be attached on either the left or right side. Dovetails 104 running longitudinally along the stock interface 101 are designed to mate with matching dovetails 105 on the stock interface attachments. A longitudinally running mounting rail 106 can be used for attaching a stock. Items can be stored in the container interior 107.

The particular shape of the illustrated dovetails 104 and matching dovetails 105 form what is known as a captured dovetail. Items using captured dovetails are connected by first aligning the dovetails and then sliding the items into position along the dovetails. Alternatively, a snapping dovetail allows the items to be aligned and pressed together such that the items flex and the dovetails snap together.

Figure 2:
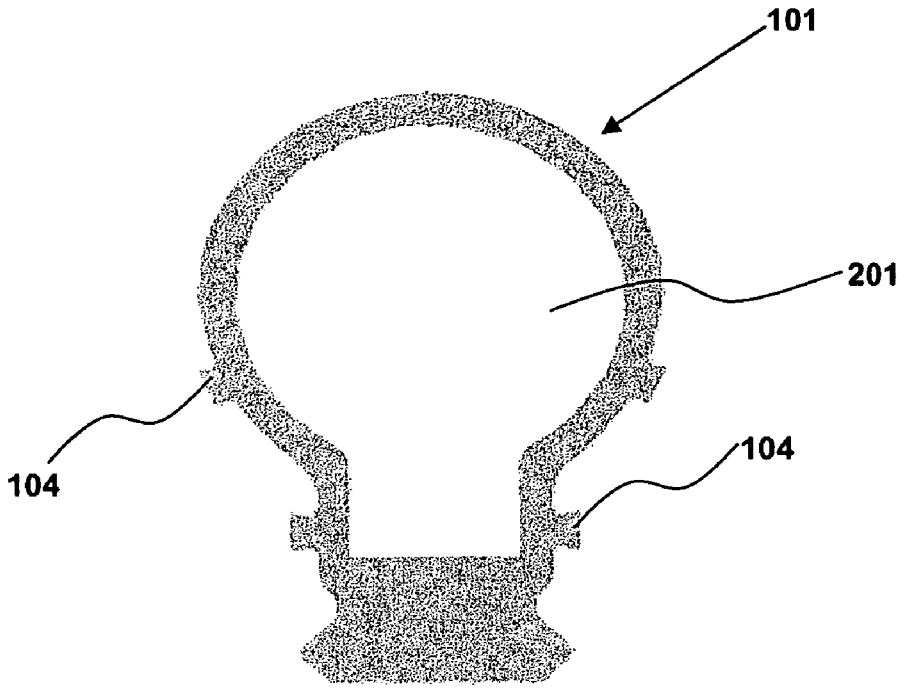
FIG. 2 illustrates a stock interface in accordance with aspects of the embodiments.

FIG. 2 illustrates a stock interface 101 in accordance with aspects of the embodiments. The dovetails 104 and mounting rail 106 can be seen. The shape of the central opening 201 is seen to match the shape of a CAR buffer tube.

Figure 3:
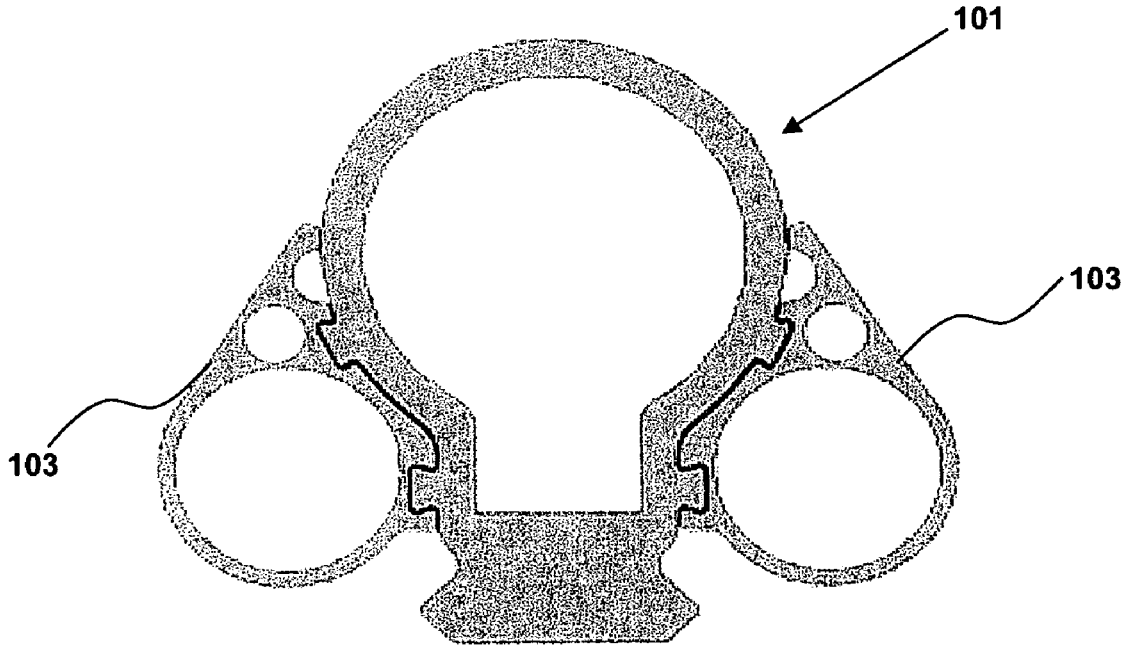
FIG. 3 illustrates a stock interface and container attachments in accordance with aspects of the embodiments.

FIG. 3 illustrates a stock interface 101 and container attachments 103 in accordance with aspects of the embodiments. The dovetails 104 and matching dovetails 105 are designed such that the container attachments 103 snap onto the stock interface 101. Adhesives or threaded fasteners are not necessary but can be used to ensure robust attachment. A threaded fastener can be passed through a hole in a stock interface attachment and into a threaded hard point on the stock interface 101. The container attachments 103 can be sealed with a plug or a cork. The container attachments 103 can be produced with one end permanently sealed.

Figure 4:
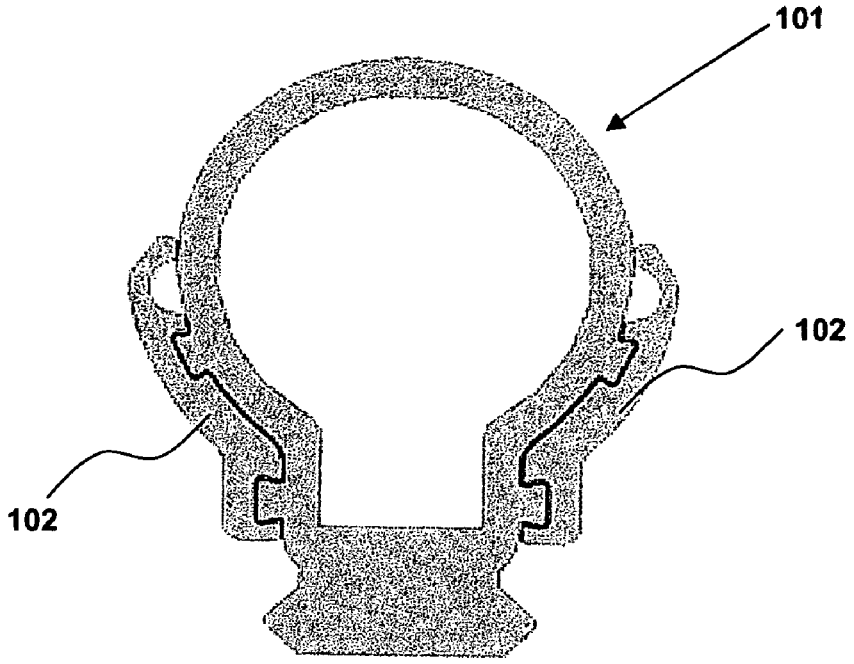
FIG. 4 illustrates a stock interface and ergonomic attachments in accordance with aspects of the embodiments.

FIG. 4 illustrates a stock interface 101 and ergonomic attachments 102 in accordance with aspects of the embodiments. The dovetails 104 and matching dovetails 105 are designed such that the ergonomic attachments 102 snap onto the stock interface 101. Adhesives or threaded fasteners are not necessary but can be used to ensure robust attachment. The ergonomic attachments 102 can produce, when attached to the stock interface 101, a smooth profile suitable for a good cheek weld as required by most marksmen.

Figure 5:
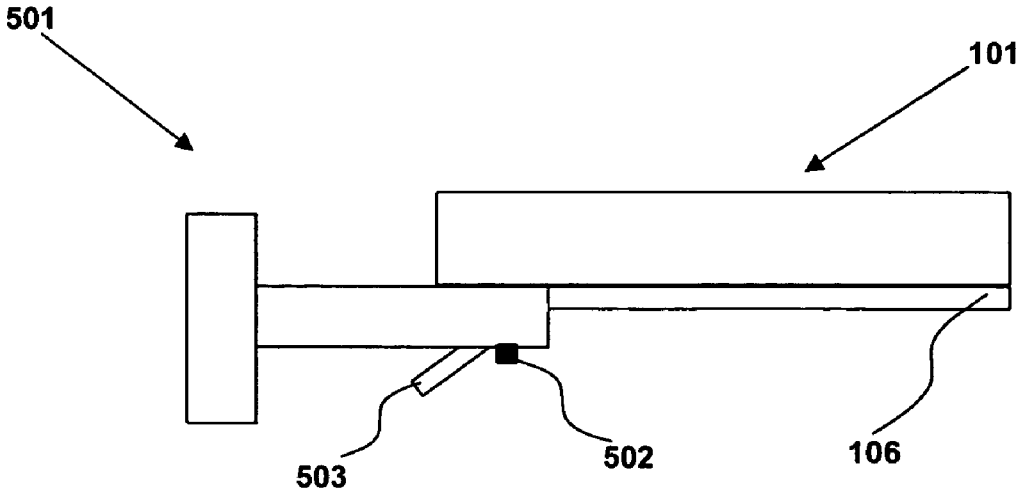
FIG. 5 illustrates a stock attached to the stock interface in accordance with aspects of the embodiments.

FIG. 5 illustrates a stylized stock 501 attached to the stock interface 101 in accordance with aspects of the embodiments. The stock 501 illustrated is an under sliding butt stock that can be slid along the mounting rail 106 and be firmly attached in a desired position. A spring can press a pin 502 in the stock 501 against the rail 106 to fix the stock in place. A lever 503 can be used to pull the pin 502 away from the rail 106 to free the stock 501. The under sliding butt stock 501 can be fixed in place even more firmly when the pin 502 slides into a hole on the under side of the mounting rail 106. Alternatively, a fixed length stock can be attached to the mounting rail 106. The fixed length stock can be slipped onto the mounting rail 106 and pressed fully forward. Pins, adhesives, fasteners, tape, hook-and-loop, or interlocking fingers, or other means can be used for securing either adjustable or permanent length stocks.

Figure 6:
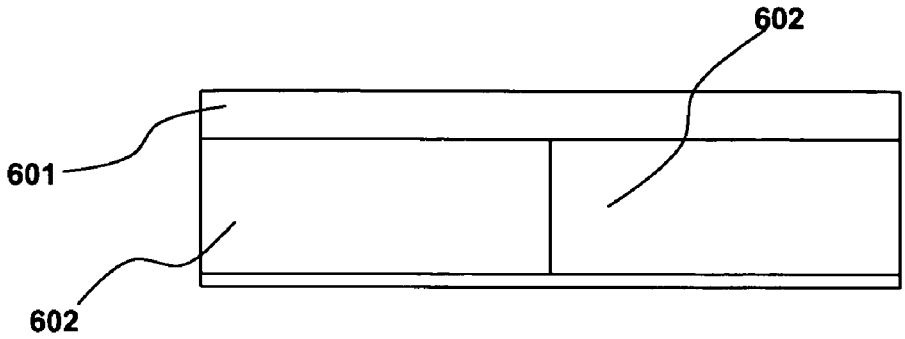
FIG. 6 illustrates two container attachments that can be mounted side by side in accordance with aspects of the embodiments.

FIG. 6 illustrates two container attachments 602 that can be mounted side by side in accordance with aspects of the embodiments. A stock interface 601 has a first and second container attachment 602 mounted side by side.

Figure 7:
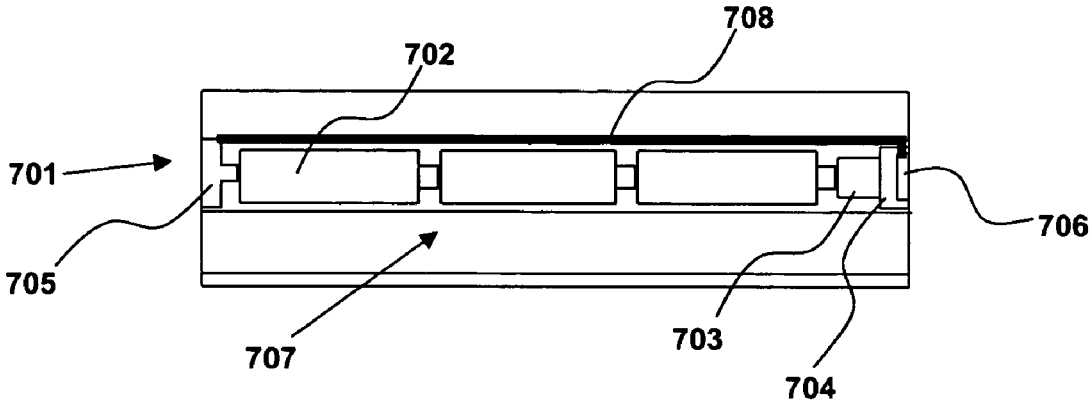
FIG. 7 illustrates a power attachment with a electrical power compartment in accordance with aspects of the embodiments.

FIG. 7 illustrates a power attachment 701 with an electrical power compartment 707 in accordance with aspects of the embodiments. The electrical power compartment 707 is illustrated as containing replaceable batteries 702, a negative electrode 705, a conductive spring 703, and a positive electrode 704. An electrical interconnect 706 is electrically attached to the positive electrode 704 and, by way of a wire 708, to the negative electrode 705.

Figure 8:
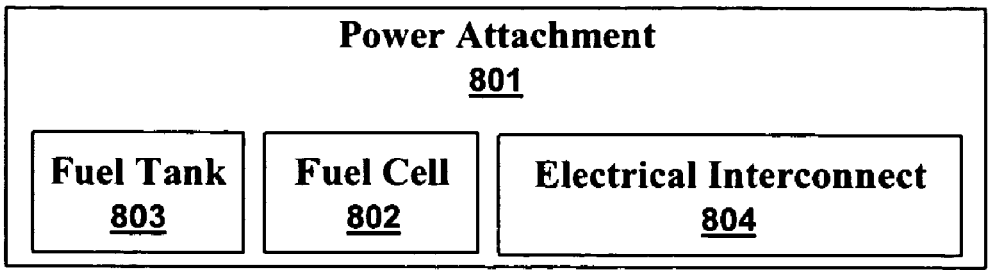
FIG. 8 illustrates a power attachment with a fuel cell in accordance with aspects of the embodiments.

FIG. 8 illustrates a high level block diagram of a power attachment 801 with a fuel cell 802 in accordance with aspects of the embodiments. A fuel tank 803 provides fuel to the fuel cell. Those practiced in the art of fuel cells are familiar with fuel cells and the fuels that can be used to power them. An electrical interconnect 804 can be used for passing electrical energy into and out of the power attachment. Those skilled in electrical equipment or electronic systems are familiar with many types of electrical interconnects including electrodes, plug and socket, card edge connectors, inductive couplers, and others.

Figure 9:
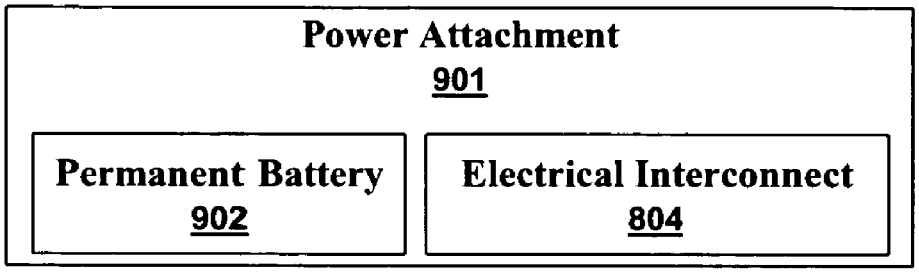
FIG. 9 illustrates a power attachment with permanent batteries in accordance with aspects of the embodiments.

FIG. 9 illustrates a high level block diagram of a power attachment 901 with permanent batteries 902 in accordance with aspects of the embodiments. Permanent batteries 902 are a permanent part of the power attachment 901. As such, the entire power attachment 901 is replaced when the permanent batteries 902 are depleted. Permanent batteries, replaceable batteries, and fuel cells are different types of electrical power source.

Figure 10:
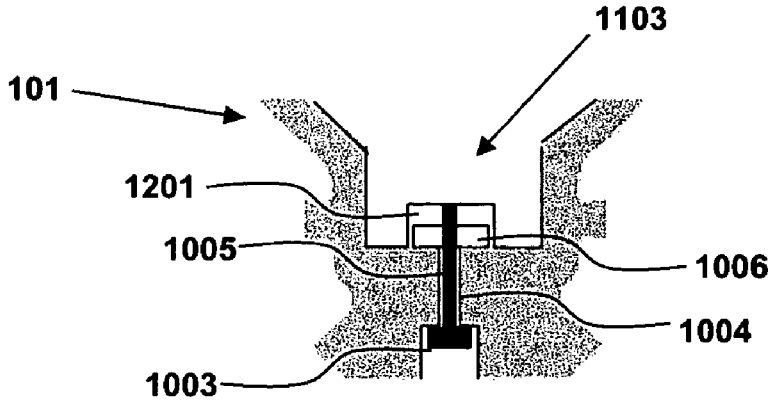
FIG. 10 illustrates a cut view of a stock interface fixedly attached to a CAR buffer tube in accordance with aspects of the embodiments.
Figure 11:
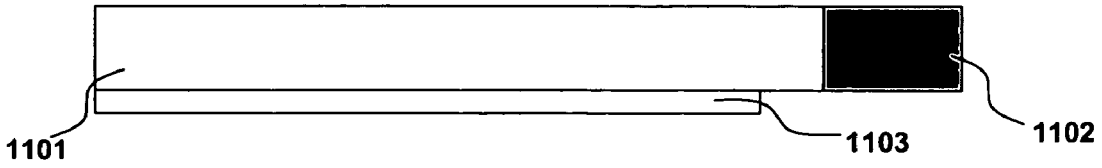
Fig. 11 (Prior Art)
FIG. 11, labeled as "prior art", illustrates a side view of an idealized CAR buffer tube.
Figure 12:
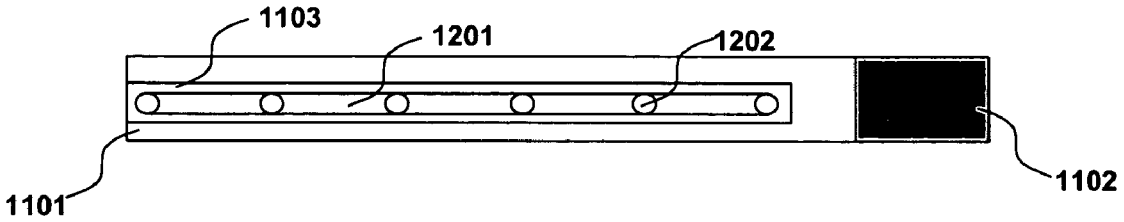
Fig. 12 (Prior Art)
FIG. 12, labeled as "prior art", illustrates a bottom view of an idealized CAR buffer tube.
Figure 13:
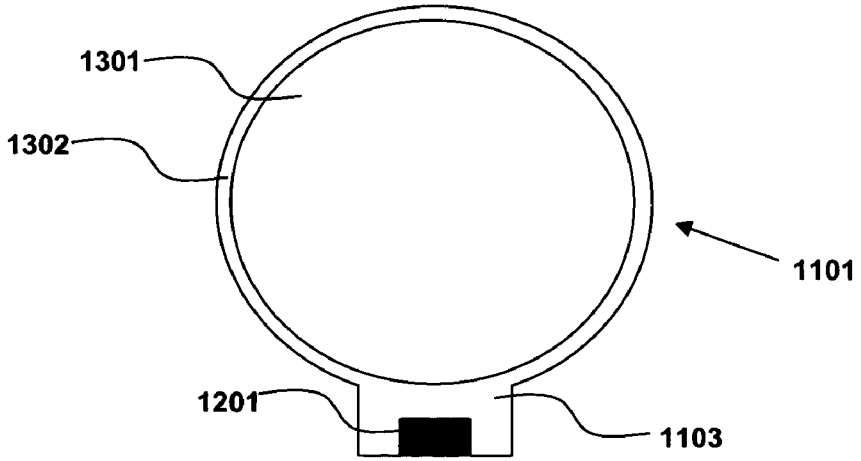
Fig. 13 (Prior Art)
FIG. 13, labeled as "prior art", illustrates a cut view of an idealized CAR buffer tube.
Figure 14:
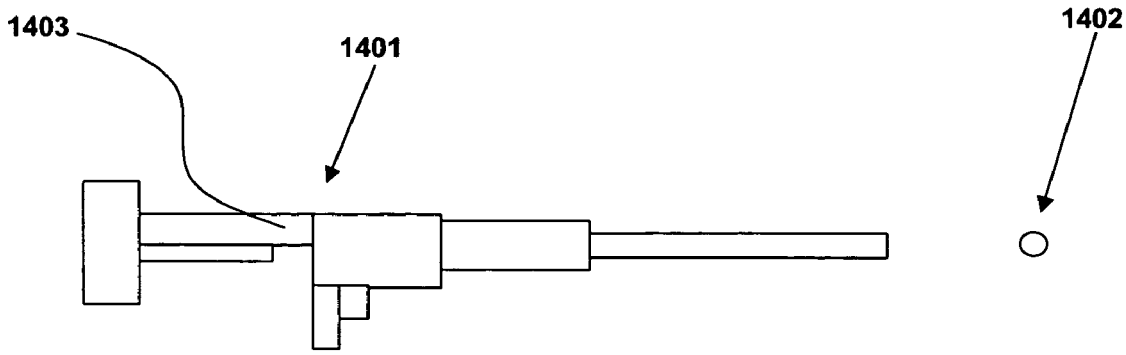
Fig. 14 (Prior Art)
FIG. 14, labeled as "prior art", illustrates a stylized toy replica firing a pellet.

FIG. 10 illustrates a cut view of a stock interface 101 fixedly attached to a CAR buffer tube in accordance with aspects of the embodiments. Fixedly attached means that the stock interface is not adjustable or otherwise free to slide along the CAR buffer tube. The stock interface 101 has been slid into position on the CAR buffer tube. The CAR buffer tube's elongated rib 1103 has a groove 1201 into which an appropriately sized bolt 1006 is placed. A bolt is appropriately sized if it cannot rotate within the groove 1201. A fastener 1005, illustrated here as a bolt, extends through an interface hole 1004 in the stock interface 101 and is threaded into the appropriately sized nut 1006. An interface hole 1004 with a countersunk portion 1003 is illustrated. Tightening the fastener 1005 causes the fastener 1005 to press into the bottom of the groove 1201 and thereby frictionally attach the stock interface 101 and the CAR buffer tube together. Aligning an interface hole 1004 with a buffer tube hole 1202 can produce a stronger binding between the stock interface 101 and the CAR buffer tube. Elongating the interface hole 1004 can ease alignment.

Threading the interface hole 1004 with a tap can dispense with the need for an appropriately sized nut 1006 and allow use of a set screw instead of a bolt 1005. A second set screw tightened into a threaded interface hole behind a first set screw can bind both set screws within the interface hole. Furthermore, a threaded interface hole adapts the stock interface for installation on either a CAR buffer tube or a cylindrical buffer tube. A bolt threaded through the interface hole 1004 presses against the side of the cylindrical buffer tube to cause a frictional attachment.

Figure 15:
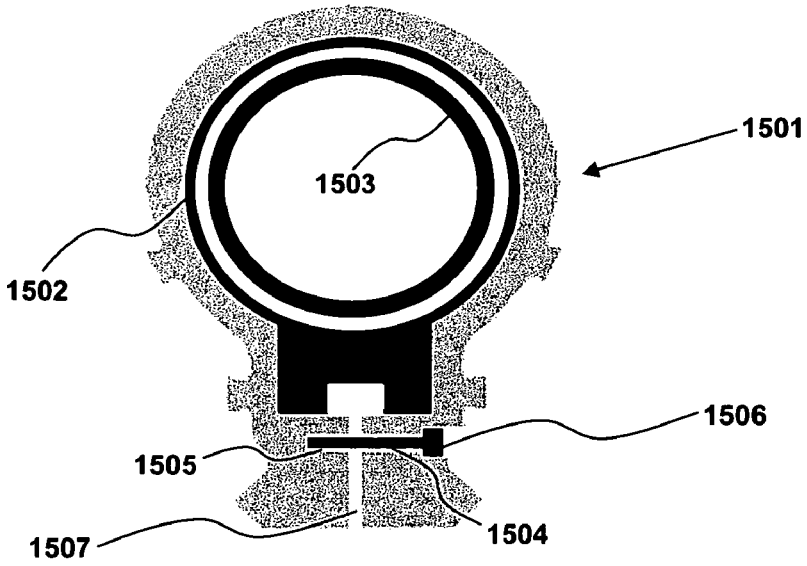
FIG. 15 illustrates clamping a stock interface to a CAR buffer tube in accordance with aspects of the embodiments.

FIG. 15 illustrates clamping a stock interface 1501 to a CAR buffer tube 1502 in accordance with aspects of the embodiments. The stock interface 1501 is placed over a CAR buffer tube 1502. The buffer spring 1503 can be seen inside the CAR buffer tube 1502. The stock interface 1501 has a bottom gap 1507 and a hole 1504. The hole end 1505 is threaded so that a bolt 1506 can be inserted into the hole 1504 and tightened. Tightening the bolt 1506 causes the bottom gap 1507 to narrow which also causes the stock interface 1501 to clamp onto the CAR buffer tube 1502. The clamping action frictionally attaches the stock interface 1501 to the CAR buffer tube 1502. Multiple holes and bolts can be used along the length of the stock interface 1501 to increase the clamping action and thereby more fixedly clamp the stock interface 1501 onto the CAR buffer tube 1502.

Figure 16:
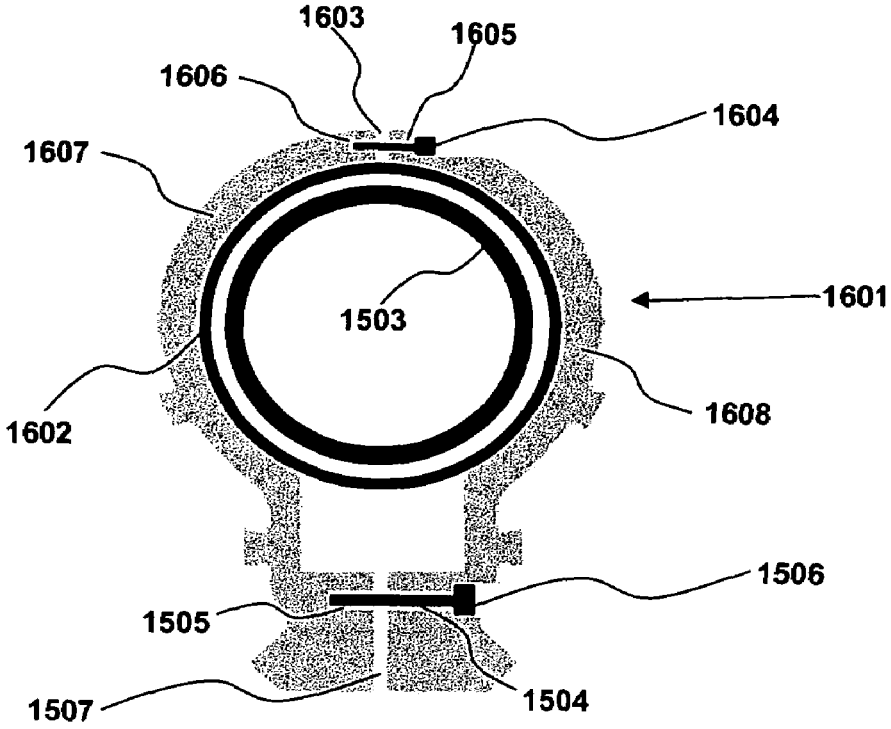
FIG. 16 illustrates clamping a stock interface to a buffer tube in accordance with aspects of the embodiments.
Figure 17:
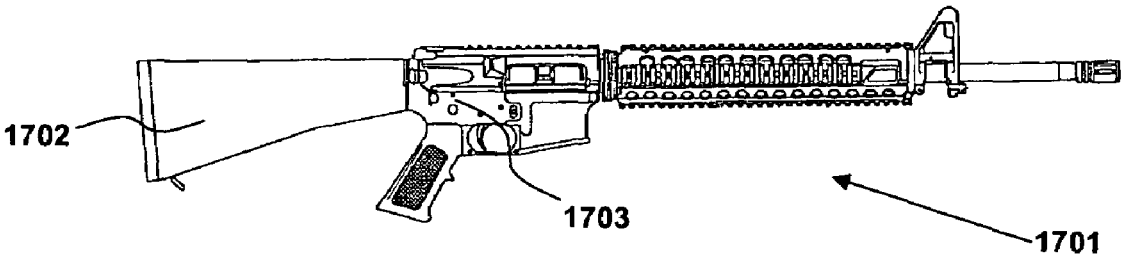
Fig. 17 (Prior Art)
FIG. 17, labeled as "prior art", illustrates a firearm 1701.
Figure 18:
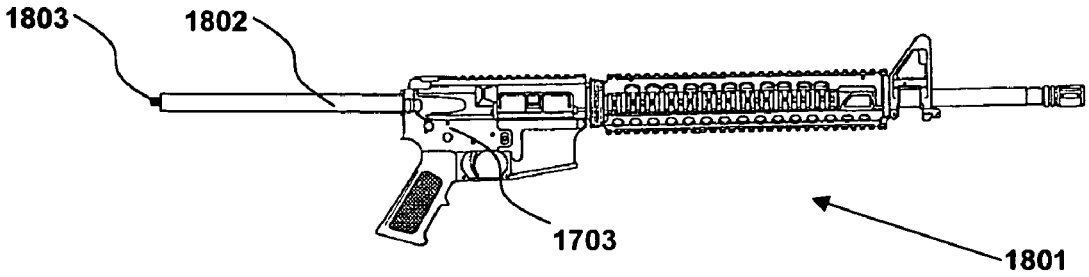
Fig. 18 (Prior Art)
FIG. 18, labeled as "prior art", illustrates a firearm 1801 with an exposed buffer tube.

FIG. 16 illustrates clamping a stock interface 1601 to a cylindrical buffer tube 1602 in accordance with aspects of the embodiments. FIG. 16 is similar to FIG. 15 in that a stock interface 1601 is placed over a buffer tube and frictionally attached by clamping. A cylindrical buffer tube is illustrated to demonstrate that clamping can be used to frictionally attach stock interfaces to either cylindrical buffer tubes or to CAR buffer tubes. The stock interface 1601 has a second gap 1603 that can be narrowed by placing a top bolt 1604 through a top hole 1605 and threading it into the top hole bottom 1606. Tightening the top bolt 1604 and the bottom bolt 1506 causes a clamping action that frictionally attaches the stock interface 1601 to clamp onto the buffer tube 1602.

The top gap 1603 and the bottom gap 1507 can, but need not, run the full length of the stock interface 1601. A stock interface 1601 with full length gaps can be separated into a threaded side 1607 and a through hole side 1608. A complete stock interface can be formed from two through hole pieces by placing a nut into the hole 1504 of one through hole piece, placing a bolt into the hole 1504 of the other through hole side piece, and threading the bolt into the nut.

What is claimed is:

1. A system comprising:

a stock interface comprising at least one dovetail;

at least one fastener wherein tightening the fastener when the stock interface is positioned over a firearm buffer tube causes the stock attachment to become frictionally fixed to the buffer tube;

at least one stock interface attachment comprising at least one matching dovetail, an electrical power compartment, and an electrical interconnect wherein the at least one dovetail and the at least one matching dovetail mate such that the at least one stock interface attachment attaches to the stock interface and wherein the electrical interconnect conducts electrical energy into and out of the at least one stock interface attachment.

2. The system of claim 1 further comprising an electrical power source within the electrical power compartment.

3. The system of claim 1 further comprising a butt stock wherein the stock interface further comprises a mounting rail and wherein the butt stock is attached to the mounting rail.

* * * * *